US005394718A

United States Patent [19]

Hötzl

[11] Patent Number: 5,394,718

[45] Date of Patent: Mar. 7, 1995

[54] POWER-ASSIST SLIDE LOCK

[75] Inventor: Manfred Hötzl, Graz, Austria

[73] Assignee: Roto Frank Eisenwarenfabrik Aktiengesellschaft, Karlsdorf Bel Graz, Austria

[21] Appl. No.: 40,539

[22] Filed: Mar. 30, 1993

[30] Foreign Application Priority Data

Apr. 1, 1992 [AT] Austria ..... 667/92

[51] Int. Cl.[6] ..... E05B 47/00

[52] U.S. Cl. ..... 70/279; 70/108; 70/280; 292/38; 292/144

[58] Field of Search ..... 70/272, 278, 279, 280, 70/103, 104, 118, 281, 282; 292/39, 144, 201

[56] References Cited

U.S. PATENT DOCUMENTS

| | | | |
|---|---|---|---|
| 4,432,573 | 2/1984 | Goldman | 70/118 |
| 4,762,348 | 8/1988 | Matsumoto | 70/279 |
| 4,833,465 | 5/1989 | Abend et al. | 292/144 |
| 5,083,448 | 1/1992 | Kärkkäinen et al. | 70/279 |
| 5,199,288 | 4/1993 | Meriläinen et al. | 70/279 |
| 5,265,452 | 11/1993 | Dawson et al. | 70/277 |

*Primary Examiner*—Lloyd A. Gall
*Assistant Examiner*—Darnell M. Boucher
*Attorney, Agent, or Firm*—Herbert Dubno; Andrew Wilford

[57] ABSTRACT

A lock assembly has a main lock housing, a bolt movable in the housing between a locked position projecting from the housing and an unlocked position largely recessed in the housing, a key-operable mechanism having an actuator movable by turning of an appropriately bitted key in the mechanism, and a linkage between the actuator and the bolt for displacing the bolt by means of the actuator. A secondary housing is provided adjacent the lock housing and an actuator element coupled and movable with the linkage extends from the lock housing to the secondary housing. The element moves in one direction relative to the secondary housing on movement of the bolt from the locked to the unlocked position and in the opposite direction on movement of the bolt from the unlocked to the locked position. An electric motor on the secondary housing connected to the element is energizable for displacing same in both directions and thereby also displacing the bolt between its positions. Switches on the secondary housing juxtaposed with the element and connected to the motor detect movement of the element in either direction when actuated through the linkage by the key and energize the motor to move the element in the same direction it is already moving in.

7 Claims, 1 Drawing Sheet

POWER-ASSIST SLIDE LOCK

FIELD OF THE INVENTION

The present invention relates to a lock. More particularly this invention concerns a slide- or bolt-type lock.

BACKGROUND OF THE INVENTION

A standard lock has a main actuator that is displaced by the appropriate key to displace a slide or bolt that is connected to the actuator by means of a linkage. Thus, for instance, the key is turned in a cylinder having an eccentric pin constituting the actuator. A gear wheel is driven by the eccentric actuator and a rack rod meshing with the gear wheel in turn operates the slide bolt, or even a plurality of slide bolts. Such a system is known for use in a heavy-duty system like a safety-deposit drawer or vault door.

Another type of lock is known where a motor is connected to the linkage and in turn is operated by an electrical controller which energizes the motor to operate the linkage when, for example, an appropriate PIN number is entered in a keypad or an appropriately coded card is swiped through a reader slot. This system can also be used to open a heavy-duty slide lock and is also frequently used on a hotel-room door.

The main disadvantage with the purely mechanical system is that the relatively small key must exert considerable force as torque to move all the various elements of the lock and open or close it. This is a particular problem with a multibolt lock assembly where the combined mass of the bolts and the linkages can be considerable. Thus in such arrangements it is relatively easy to break or bend the key.

While there is no such mechanical strain on the purely electrical systems, they are rendered inoperative when power fails. Furthermore they often require sophisticated electronics so that they are expensive.

OBJECTS OF THE INVENTION

It is therefore an object of the present invention to provide an improved lock.

Another object is the provision of such an improved lock which overcomes the above-given disadvantages, that is which is relatively easy to operate, even with a key, and that nonetheless is not of complex construction.

SUMMARY OF THE INVENTION

A lock assembly has according to the invention a main lock housing, a bolt movable in the housing between a locked position projecting from the housing and an unlocked position largely recessed in the housing, a key-operable mechanism having an actuator movable by turning of an appropriately bitted key in the mechanism, and a linkage between the actuator and the bolt for displacing the bolt by means of the actuator. A secondary housing is provided adjacent the lock housing and an actuator element coupled and movable with the linkage extends from the lock housing to the secondary housing. The element moves in one direction relative to the secondary housing on movement of the bolt from the locked to the unlocked position and in the opposite direction on movement of the bolt from the unlocked to the locked position. An electric motor on the secondary housing connected to the element is energizable for displacing same in both directions and thereby also displacing the bolt between its positions. Switches on the secondary housing juxtaposed with the element and connected to the motor detect movement of the element in either direction when actuated through the linkage by the key and energize the motor to move the element in the same direction it is already moving in.

Thus with this system the key is used in the standard manner, but once the linkage is set in motion by the key, the power-assist motor takes over to supply the force to move the various elements of the lock. Thus the key need not be relied on to exert the considerable torque necessary to operate an extensive linkage, in particular in a multibolt lock. Thus even a relatively cheap flat key can be used for such a lock. In fact the system can be made to respond rather sensitively so that in fact the key is merely starting to take up all the play in the linkages when the power assist is tripped.

According to the invention the switch system includes means for stopping energization of the motor when current consumption exceeds a predetermined limit. Thus once the lock is fully opened or closed, the motor is automatically shut off, preventing damage to the motor and eliminating the need for a second set of end-position switches.

The linkage of this invention includes a rack bar extending from the main housing. The lock further has according to the invention a least one secondary bolt displaceable between a locked and an unlocked position and a secondary linkage between the rack bar and the secondary bolt for displacing the secondary bolt synchronously with the first-mentioned bolt. It is possible for the rack bar to form the element.

Either way, the rack bar carries an actuating formation engageable with the switches. The linkage includes at least one toothed gear and the element is a rack bar meshing with the gear.

The drive can be provided with a normally open clutch connected between the motor and the element. The switches are connected to the clutch to engage and disengage it. Thus if power is lost, the motor is disconnected and the lock can still be operated manually.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
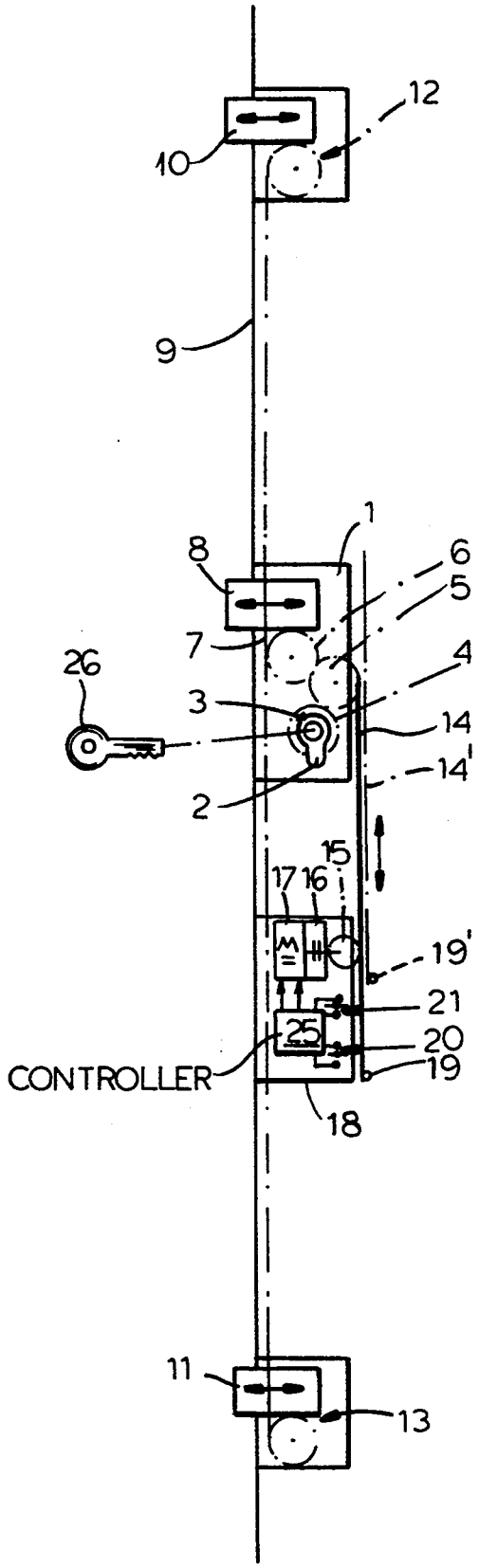
FIG. 1 is a largely schematic view of a lock assembly according to the invention.

As seen in FIG. 1 a main lock housing 1 mounted along a door edge 9 has a standard key-operated cylinder 2 having in turn an actuating element 3 that can rotate a gear wheel 3 when an appropriately bitted key 26 is inserted in the cylinder 2 and turned. The wheel 3 is connected via a linkage formed by two more gear wheels 5 and 6 to a primary door bolt 8 that can move from the illustrated locked position extending past the door edge 9 to a position recessed in the door edge 9 and housing 1.

A connecting bar 8 formed as a rack meshes with the gear wheel 6 and with further gear wheels 12 and 13 that are provided outside the housing 1 in mesh with secondary bolts 10 and 11. The gearing is such that when the key 26 is rotated in the cylinder the secondary bolts 10 and 11 will move out and in synchronously with the primary bolt 8.

In accordance with the invention a secondary bar 14 formed as a rack meshes at one end with the gear 5 and at its other end with another gear 15 connected via a clutch 16 to a motor 17 provided in a secondary housing 18 spaced from the main housing 1. The outer end of this bar 14 is provided with an actuator 19 that can operate either of two reversing switches 20 or 21 also provided in the housing 18 and connected via a control circuit 25 with the motor 17. This controller 25 is provided with an overload protector that automatically shuts the motor 17 off when its current consumption exceeds a predetermined limit which corresponds to stalling of the motor 17 against a load.

This device operates as follows:

The key 26 is inserted into the cylinder 2 and rotated through about 10°, thereby rotating the gears 5 and 6 slightly and lifting the bar 14 slightly from the solid-line position. This action causes the actuator element 19 to trip the switch 20 which closes the clutch 16 and starts the motor 17 rotating in a direction to continue lifting the bar 14. The motor 16 therefore takes over the work of extending the bolts 8, 10, and 11 to their locked positions. Once the uppermost position for the bar 14 and actuator shown in dot-dash lines at 14' and 19' is reached, the switch 21 is actuated and the motor 17 stalls. This automatically shuts the motor 17 off. Such power-assisted operation will also turn the core of the cylinder 2 and the key 26 therein.

Subsequent opposite rotation of the cylinder 2 will cause the bar to move down from the position 14' and the switch 21 will similarly close the clutch 16 and start the motor 17, but in the opposite direction for power-assisted retraction of the bolts 8, 10, and 11 and unlocking of the system.

If power fails, the clutch 16 opens so that the system can be locked and unlocked manually with the key 26.

Figure 2:
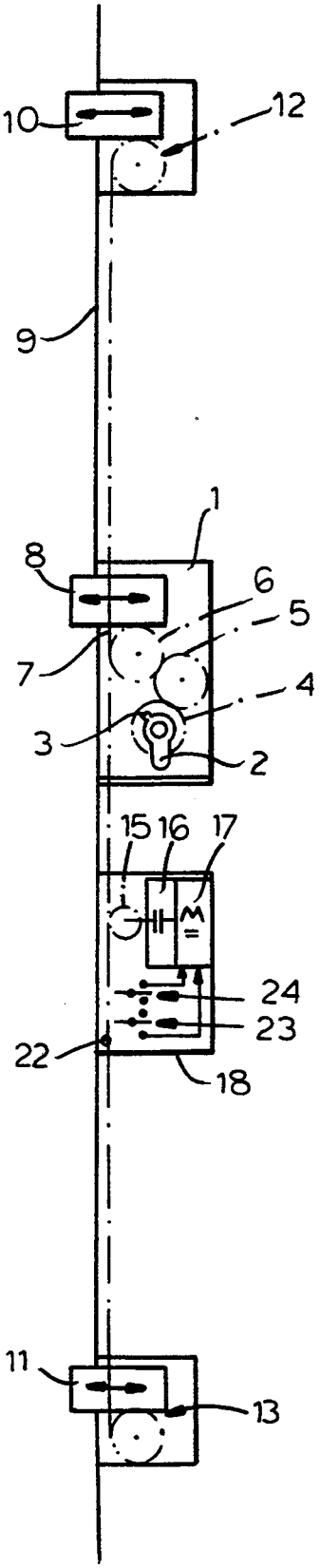
FIG. 2 is a view like FIG. 1 of another assembly in accordance with this invention.

In the arrangement of FIG. 2 a separate actuator bar 14 is dispensed with. Instead an actuator 22 is provided right on the secondary bar 7 to coact with switches 23 and 24 equivalent to the switches 20 and 21. As in FIG. 1, these switches 23 and 24 can be contactless reed switches actuated by a magnet forming the actuator 19 or 22.

I claim:

1. A lock assembly comprising:

a main lock housing;

a bolt movable in the housing between a locked position projecting from the housing and an unlocked position largely recessed in the housing;

a key-operable mechanism having an actuator movable by turning of an appropriately bitted key in the mechanism;

a gear train between the actuator and the bolt for displacing the bolt by means of the actuator;

a secondary housing adjacent the lock housing;

a toothed actuator bar meshing and movable with the linkage gear train and extending from the lock housing to the secondary housing, the bar moving in one direction relative to the secondary housing on movement of the bolt from the locked to the unlocked position and in the opposite direction on movement of the bolt from the unlocked to the locked position;

drive means including an electric motor on the secondary housing connected to the bar and energizable for displacing same in both directions and thereby also displacing the bolt between its positions; and switch means on the secondary housing juxtaposed with the bar and connected to the motor for detecting movement of the bar in either direction when actuated through the gear train by the key for energizing the motor to move the bar in the same direction it is already moving in.

2. The lock assembly defined in claim 1 wherein the switch means includes means for stopping energization of the motor when current consumption exceeds a predetermined limit.

3. The lock assembly defined in claim 1 wherein the gear train includes a rack bar extending from the main housing, the lock further comprising:

a least one secondary bolt displaceable between a locked and an unlocked position; and a secondary gear train between the rack bar and the secondary bolt for displacing the secondary bolt synchronously with the first-mentioned bolt.

4. The lock assembly defined in claim 3 wherein the rack bar forms the actuator bar.

5. The lock assembly defined in claim 4 wherein the rack bar carries an actuating formation engageable with the switch means.

6. The lock assembly defined in claim 1 wherein the gear train includes at least one toothed gear, the bar meshing with the gear.

7. The lock assembly defined in claim 1 wherein the drive means further includes a clutch connected between the motor and the bar and displaceable between an engaged condition coupling the motor to the bar and a disengaged position decoupling the motor from the bar, the switch means being connected to the clutch to move it between its disengaged and engaged positions.

* * * * *